US011701561B2

(12) United States Patent
Gilroy

(10) Patent No.: US 11,701,561 B2
(45) Date of Patent: Jul. 18, 2023

(54) LACROSSE STICK AND SUBSTRATE FOR POCKET

(71) Applicant: Christopher Gilroy, Carlisle, PA (US)

(72) Inventor: Christopher Gilroy, Carlisle, PA (US)

( * ) Notice: Subject to any disclaimer, the term of this patent is extended or adjusted under 35 U.S.C. 154(b) by 0 days.

(21) Appl. No.: 16/934,488

(22) Filed: Jul. 21, 2020

(65) Prior Publication Data

US 2022/0023728 A1 Jan. 27, 2022

(51) Int. Cl.

| | |
|---|---|
| ***A63B 59/20*** | (2015.01) |
| ***D04B 1/22*** | (2006.01) |
| ***D04B 21/10*** | (2006.01) |
| ***D04B 21/20*** | (2006.01) |
| ***A63B 102/14*** | (2015.01) |

(52) U.S. Cl.

CPC ..... *A63B 59/20* (2015.10); *D04B 1/22* (2013.01); *D04B 21/10* (2013.01); *D04B 21/20* (2013.01); *A63B 2102/14* (2015.10); *A63B 2209/00* (2013.01); *D10B 2507/02* (2013.01)

(58) Field of Classification Search

CPC . A63B 59/20; A63B 2102/14; A63B 2209/00; D04B 1/22; D04B 21/10; D04B 21/20; D10B 2507/02

See application file for complete search history.

(56) References Cited

U.S. PATENT DOCUMENTS

| | | | | |
|---|---|---|---|---|
| 3,807,200 | A * | 4/1974 | Liwski | D04B 1/22 66/170 |
| 7,192,369 | B2 | 3/2007 | Morrow | |
| 9,259,883 | B1 | 2/2016 | Morrow et al. | |
| 9,468,824 | B1 | 10/2016 | Miceli | |
| 10,226,673 | B2 | 3/2019 | Morrow et al. | |
| 10,455,885 | B2 | 10/2019 | Tamm | |
| 2016/0024693 | A1 | 1/2016 | Henry et al. | |
| 2016/0101333 | A1 | 4/2016 | McCampbell | |
| 2017/0340934 | A1* | 11/2017 | Kohler | D03D 1/00 |
| 2019/0009153 | A1* | 1/2019 | Morrow | A63B 59/20 |

OTHER PUBLICATIONS https://www.allfreeknitting.com/Tips-for-Knitting/Knitting-Needle-Sizes, May 13, 2020 (Year: 2020).* https://knitting.com/how-to-purl-stitch/#:~:text=What%20are%20the%20benefits%20of%20purl%20stitching%3F%20Purl,satin-like%20finish%20to%20a%20more%20nubby%2C%20textured%20fabric. (Year: 2022).*

* cited by examiner

*Primary Examiner* — Jeffrey S Vanderveen

(74) *Attorney, Agent, or Firm* — Ballard Spahr LLP

(57) ABSTRACT

A substrate is mountable on a lacrosse stick head to form a pocket. The head has a throat attached to a shaft, a ball stop attached to the throat, a scoop distal to the throat, and sidewalls extending between the ball stop and the scoop. The substrate includes a top portion and a bottom portion. The top portion is positioned proximate to the scoop and the bottom portion is positioned between the top and the ball stop. The top and bottom portions include yarn knit to form the substrate. A method of making the substrate includes casting the yarn onto a needle, knitting the top and bottom portions, casting the yarn off the needle, tying off the yarn and attaching the substrate to the head.

27 Claims, 10 Drawing Sheets

LACROSSE STICK AND SUBSTRATE FOR POCKET

FIELD OF THE INVENTION

This invention concerns a knitted substrate attached to the head of a lacrosse stick to form a pocket.

BACKGROUND

A lacrosse stick has a head attached to a shaft. The head has a throat local to the stick attachment, a scoop distal to the throat, and sidewalls between the throat and the scoop. The head has a pocket for holding, throwing and catching the ball. The ball is carried in the pocket local to the throat. When the ball is thrown the ball travels from the throat toward the scoop then outward away from the head. The pocket attaches to the head at the scoop, sidewalls, and throat. The pocket may be either traditional or modern mesh. The traditional pocket includes leather strings running vertically from the throat to the scoop interwoven with nylon. The use of the traditional pocket has been mostly supplanted by the use of the modern mesh pocket. The modern mesh pocket is constructed from integrally connected nylon fibers which are woven together to form diamond shaped openings in the mesh. The design of the diamond shaped openings effects the handling characteristics of the ball when carried in and thrown from the pocket. The typical modern mesh pocket comprises rows of nine to ten diamond shaped openings. Both traditional and mesh pockets have fixed connections between each diamond shaped opening that may not effectively conform to the shape of the ball when carried nor effectively guide the ball to and from the scoop when caught or thrown.

There is clearly a need for a pocket design which can retain the ball, conform to the shape of the ball and effectively guide the ball to and from the scoop when the ball is caught or thrown.

SUMMARY

This invention concerns a substrate mountable on a lacrosse stick head. In an example embodiment, the head includes a throat attached to a shaft, a ball stop attached to the throat, a scoop located distal to the throat, and sidewalls extending between the ball stop and the scoop. The substrate comprises a plurality of portions having different stiffness characteristics. The portions comprise a continuous strand of yarn knit to form the substrate.

As an example the plurality of portions comprise a top and bottom portions. The top portion is positioned proximate to the scoop. The bottom portion is positioned between the top portion and the ball stop. In a particular example, the bottom portion is knit with purl stitches. In another particular example, the top portion is knit with purl stitches.

In an example, the top portion comprises at least one shooting string positioned in spaced relation from the scoop, and transverse to the sidewalls. In a particular example, the at least one shooting string comprises a row of plain stitches. In an example, the at least one shooting string comprises a row knit with alternating plain and purl stitches. In a particular example, the at least one shooting string comprises a fiber, attached to the substrate. The fiber is selected from a group consisting essentially of: cotton cord, nylon cord, polyester-cotton cord, cotton shoelace, nylon shoelace, polyester-cotton shoelace, hockey shoelace and combinations thereof.

As an example, the top portion is knit with plain stitches. In an example, the yarn is selected from a group consisting essentially of: nylon, waxed cotton, natural rope, micro-para cord and combinations thereof.

In an example, the substrate further comprises a middle portion positioned between the top portion and the bottom portion. The middle portion comprises yarn knit to form a substrate. In a particular example, the bottom portion is knit with plain stitches. In a further particular example, the middle portion is knit with purl stitches.

In an example embodiment, the plurality of portions comprise a first portion, a second portion and a central portion. The portions are position proximate to the side walls. The central portion extends from the ball stop to the scoop and is positioned between the first and second portions.

As an example, the first and second portions are knit with plain stitches. In an example, the central portion is knit with purl stitches. In a particular example, the plurality of portions further comprise a first reinforcement and a second reinforcement. The reinforcements are in spaced apart relation to one another. The first reinforcement is positioned between the first portion and the central portion and the second reinforcement is positioned between the second portion and the central portion. Each of the reinforcements comprises a column knit with plain stitches.

In an example, the central portion comprises a first part extending from the ball stop and a second part positioned between the first part and the scoop. In a particular example, the first part is knit with purl stitches. In a further particular example, the second part is knit with plain stitches.

This invention further concerns a lacrosse stick. The stick comprises a shaft, a head, and a substrate. The head comprises a throat attached to the shaft, a ball stop attached to the throat, a scoop distal to the throat, and sidewalls extending between the ball stop and the scoop. The substrate comprises a plurality of portions having different stiffness characteristics. The portions comprise a continuous strand of yarn knit to form the substrate.

As an example the plurality of portions comprise a top and bottom portions. The top portion is positioned proximate to the scoop. The bottom portion is positioned between the top portion and the ball stop. In a particular example, the bottom portion is knit with purl stitches. In another particular example, the top portion is knit with purl stitches.

In an example, the top portion comprises at least one shooting string positioned in spaced relation from the scoop, and transverse to the sidewalls. In a particular example, the at least one shooting string comprises a row of plain stitches. In an example, the at least one shooting string comprises a row knit with alternating plain and purl stitches. In a particular example, the at least one shooting string comprises a fiber, attached to the substrate. The fiber is selected from a group consisting essentially of: cotton cord, nylon cord, polyester-cotton cord, cotton shoelace, nylon shoelace, polyester-cotton shoelace, hockey shoelace and combinations thereof.

In an example, the yarn is selected from a group consisting essentially of: nylon, waxed cotton, natural rope, micro-para cord and combinations thereof.

As an example, the top portion is knit with plain stitches. In a particular example, the substrate further comprises a middle portion positioned between the top portion and the bottom portion. The middle portion comprises yarn knit to form a substrate. In a particular example, the bottom portion is knit with plain stitches. In another particular example, the middle portion is knit with purl stitches.

In an example embodiment, the plurality of portions comprise a first portion, a second portion and a central portion. The portions are position proximate to the side walls. The central portion extends from the ball stop to the scoop and is positioned between the first and second portions.

As an example, the first and second portions are knit with plain stitches. In an example, the central portion is knit with purl stitches. In a particular example, the plurality of portions further comprise a first reinforcement and a second reinforcement. The reinforcements are in spaced apart relation to one another. The first reinforcement is positioned between the first portion and the central portion and the second reinforcement is positioned between the second portion and the central portion. Each of the reinforcements comprises a column knit with plain stitches.

In an example, the central portion comprises a first part extending from the ball stop and a second part positioned between the first part and the scoop. In a particular example, the first part is knit with purl stitches. In a further particular example, the second part is knit with plain stitches.

This invention further concerns a method of making a substrate mountable on a lacrosse stick head. The head includes a throat attached to the shaft, a ball stop attached to the throat, a scoop distal to the throat, and sidewalls extending between the ball stop and the scoop. The substrate comprises a plurality of portions having different stiffness characteristics. The portions comprise a continuous strand of yarn knit to form the substrate. In an example, the method comprises:

casting a continuous strand of yarn onto a needle;
knitting the portions with the yarn;
casting the yarn off the knitting needle;
tying off the yarn; and
attaching the substrate to the head.

As an example, the knitting the plurality of portions step further comprises:

knitting a top portion proximate to the scoop with the yarn, and
knitting a bottom portion between the top portion and the ball stop with the yarn.

As an example the knitting the bottom portion step further comprises knitting the bottom portion with purl stitches. In an example, the knitting the top portion step comprises, knitting at least one shooting string in spaced apart relation from the scoop and transverse to the sidewalls. In a particular example, the knitting the at least one shooting string step further comprises, knitting the at least one shooting string with alternating plain and purl stitches. In an example, the knitting the top portion step comprises knitting the top portion with plain stitches.

In an example, the casting step comprises casting the yarn onto the needle comprising a diameter ranging from 5 mm to 20 mm.

In an example, wherein the knitting the plurality of portions step further comprises:

knitting a middle portion positioned between the top portion and the bottom portion with yarn.

In a particular example, the knitting the top and bottom portion steps comprise, knitting the top and bottom portions with plain stitches. In another particular example, the knitting the bottom and top portion steps comprise, knitting the yarn onto the needle having a diameter of 8 mm to form the top and bottom portions. In a further particular example, the knitting the middle portion step comprises knitting the yarn onto the needle having a diameter of 10 mm to form the middle portion.

As an example, the knitting the plurality of portions step may comprise:

knitting a first portion and a second portion with the yarn, where the portions are positioned proximate to the sidewalls, and knitting a central portion with the yarn, where the central portion extends from the ball stop to the scoop and is positioned between the first and second portions.

In a particular example, the knitting the first portion and second portion steps may comprise, knitting the portions with plain stitches. In another particular example, the knitting the central portion step may comprise knitting the central portion with purl stitches.

In an example, the knitting the plurality of portions step further comprises:

knitting a first reinforcement and a second reinforcement.

The reinforcements are in spaced apart relation to one another. The first reinforcement is positioned between the first portion and the central portion. The second reinforcement is positioned between the second portion and the central portion. In a particular example, the knitting the first and second reinforcement step further comprises:

knitting each of the reinforcements with a column of plain stitches.

As an example the knitting the central portion step comprises:

knitting a first part with yarn, and
knitting a second part with yarn.

The first part extends from the ball stop and the second part is positioned between the first part and the scoop. In a particular example, wherein knitting the first part further comprises knitting the first part with purl stitches. In a further particular example, wherein knitting the second part further comprises knitting the second part with plain stitches.

As an example, the casting step comprises selecting yarn from a group consisting essentially of: nylon, waxed cotton, natural rope, micro-para cord and combinations thereof.

In an example, the knitting the first portion and second portion steps comprise knitting the yarn onto the needle having a diameter of 8 mm to form the first and second portions. As an example, the knitting of the first part step comprises, knitting the yarn onto the needle having a diameter of 10 mm to form the first part. In a particular example, the knitting the second part step comprises knitting the yarn onto the needle having a diameter of 8 mm to form the second part.

As an example, the knitting the first and second portion steps comprise knitting the yarn onto the needle having a diameter of 8 mm to form the first and second portions.

DETAILED DESCRIPTIONS

Figure 1:
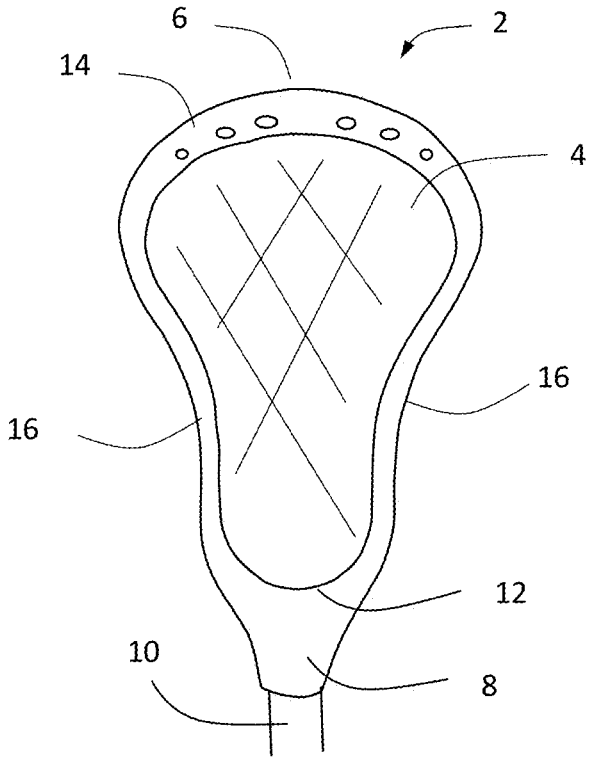
FIG. 1 is a plan view of a portion of a lacrosse stick having an example substrate according to the invention.
Figure 2:
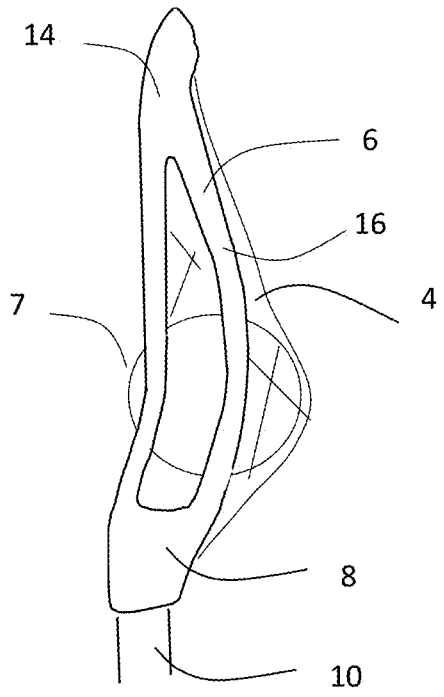
FIG. 2 is a side view of the lacrosse stick with the example substrate shown in FIG. 1.

An example of a lacrosse stick 2 according to the invention is shown in FIGS. 1 and 2. The stick 2 has a substrate 4, which forms a pocket, mountable of a head 6. The head 6 and the substrate 4 support and throw a ball 7, shown in FIG. 2. The head 6 comprises a throat 8, a ball stop 12, a scoop 14, and sidewalls 16. The throat 8 is attached to a shaft 10 (a portion of which is shown in FIG. 1) which is held by the lacrosse player. The ball stop 12 is attached to the throat 8. The scoop 14 is located distal to the throat 8. The sidewalls 16 extend between the ball stop 12 and the scoop 14.

During a lacrosse game the ball is supported by the substrate 4, with the ball positioned proximate to the ball stop 12. As the ball is shot, it travels from a position local to the ball stop 12 toward the scoop 14, then past the scoop 14 and away from the head 6. When the ball is caught it travels from a position local to the scoop 14 toward the ball stop 12. The configuration of the substrate effects the handling characteristics of the ball when carried by supporting the ball, and when thrown by guiding the ball to and from the ball stop 12 to scoop 14. The various example substrate embodiments comprising a plurality of portions having different stiffness characteristics are described below.

Figure 3:
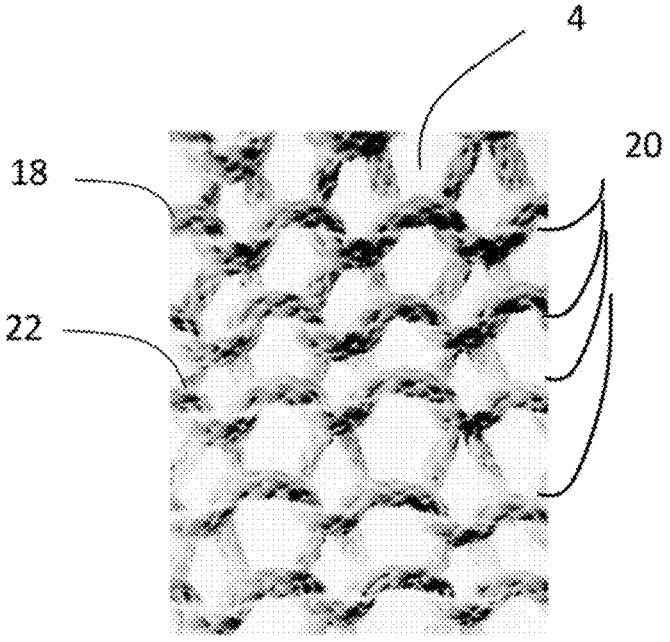
FIG. 3 is a plan view of a portion of an example substrate according to the invention.
Figure 4:
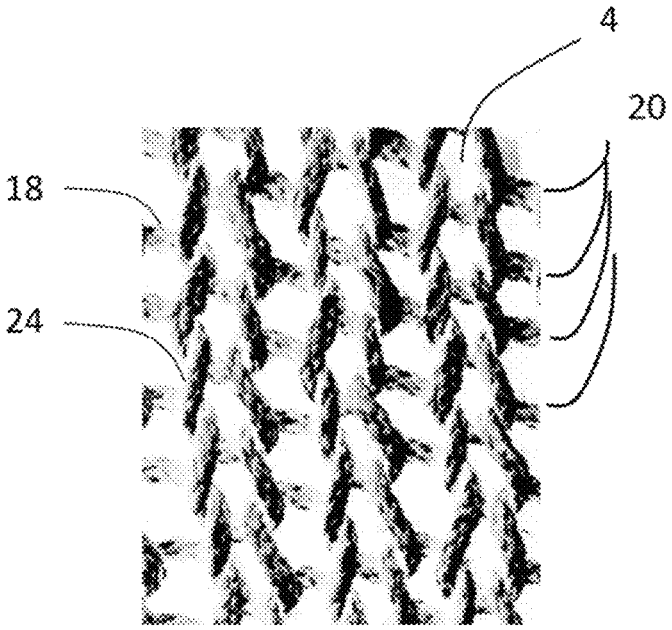
FIG. 4 is a plan view of a portion of an example substrate according to the invention.

FIGS. 3 and 4 show examples of portions of substrate 4 comprising a continuous strand of yarn 18 knit to form the substrate 4. The examples show substrate 4 formed by weft knitting with plain and purl stitches. FIG. 3 shows a portion of substrate 4 comprising the yarn 18 knit with multiple rows 20 of purl stitches 22. FIG. 4 shows a portion of substrate 4 comprising the yarn 18 knit with multiple rows 20 of plain stitches 24. Each row may also comprise combinations of plain and purl stitches.

Figure 5:
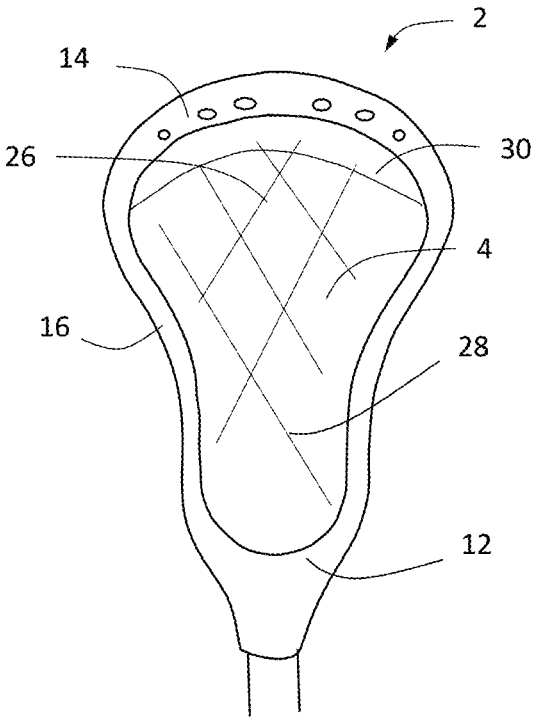
FIG. 5 is a plan view a portion of a lacrosse stick having an example substrate according to the invention, showing a shooting string.

An example substrate 4 comprising a top portion 26 and a bottom portion 28 is shown in FIG. 5. The top portion 26 is positioned proximate to the scoop 14 and the bottom portion 28 is positioned between the top portion 26 and the ball stop 12. The top and bottom portions, 26 and 28, may be knit with purl stitches 22 (see FIG. 3).

Figure 6:
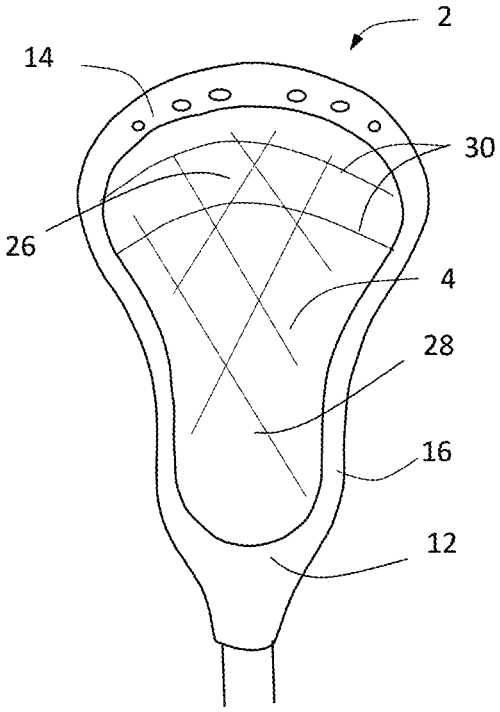
FIG. 6 is a plan view of a portion of a lacrosse stick having an example substrate according to the invention, showing shooting strings.

As shown in FIG. 5, the top portion 26 may include at least one shooting string 30 positioned in space relation to said scoop 14 and positioned transverse to the sidewalls 16. The shooting string 30 stiffens the top portion 26 proximate to scoop 14 preventing excessive deflection thus improving the support of the ball when thrown. FIG. 5 shows an example of substrate 4 including one shooting string 30. FIG. 6 shows an example with two shooting strings 30 positioned in the top portion 26. The two shooting strings 30 shown in FIG. 6 are in spaced apart relation to one another. The shooting string 30 may comprise a row of plain stitches 24. The row of plain stitches advantageously assists in directing the ball toward and away from the ball stop when the ball is caught or thrown. The shooting string 30 may also comprise a row of alternating plain and purl stitches. The row of alternating plain to purl stitches also advantageously assists in directing the ball toward and away from the ball stop when the ball is caught or thrown. The shooting string 30 may further comprise a fiber attached to the substrate. In this example, the fiber may be selected from a group consisting essentially of: cotton cord, nylon cord, polyester-cotton cord, cotton shoelace, nylon shoelace, polyester-cotton shoelace, hockey shoelace and combinations thereof.

Figure 7:
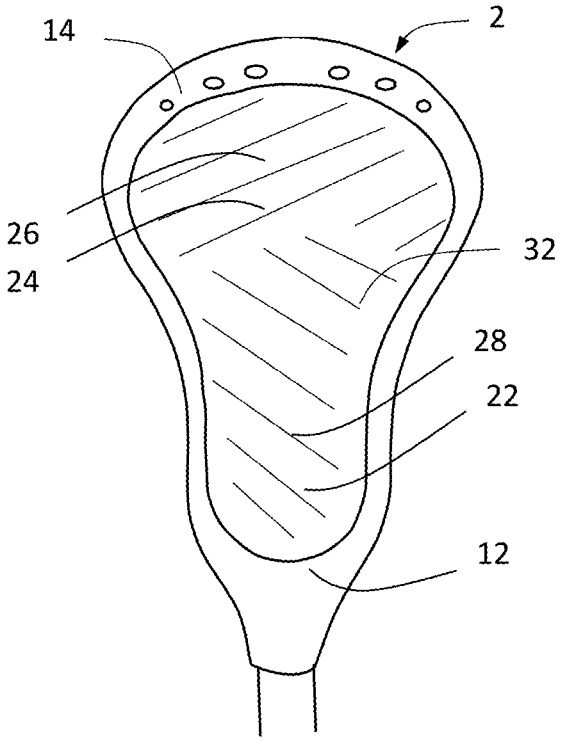
FIG. 7 is a plan view of a portion of a lacrosse stick having an example substrate according to the invention, showing top and bottom portions thereof.

FIG. 7 shows an example of substrate 32 in which the bottom portion 28 is knit with purl stitches 22 and the top portion 26 is knit with plain stitches 24.

Figure 8:
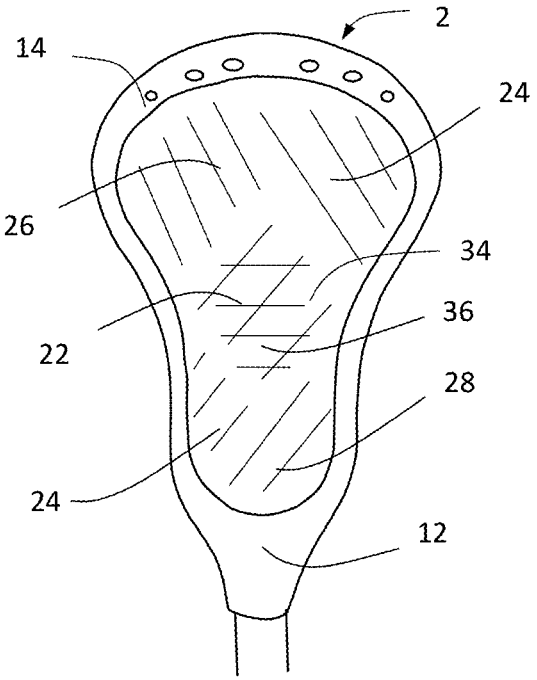
FIG. 8 is a plan view of a portion of a lacrosse stick having an example substrate according to the invention, showing top, bottom and middle portions thereof.

Another example, substrate 34, comprising a top portion 26, a bottom portion 28 and a middle portion 36 is shown in FIG. 8. The middle portion 36 is positioned between the top portion 26 and the bottom portion 28. Like the top and bottom portions, 26 and 28, the middle portion 36 also includes yarn knit to form the substrate 34. In this example, the top and bottom portions, 26 and 28, of the substrate 34 may be knit with plain stitches 24. The middle portion 36 of substrate 34 may be knit with purl stitches 22.

Figure 9:
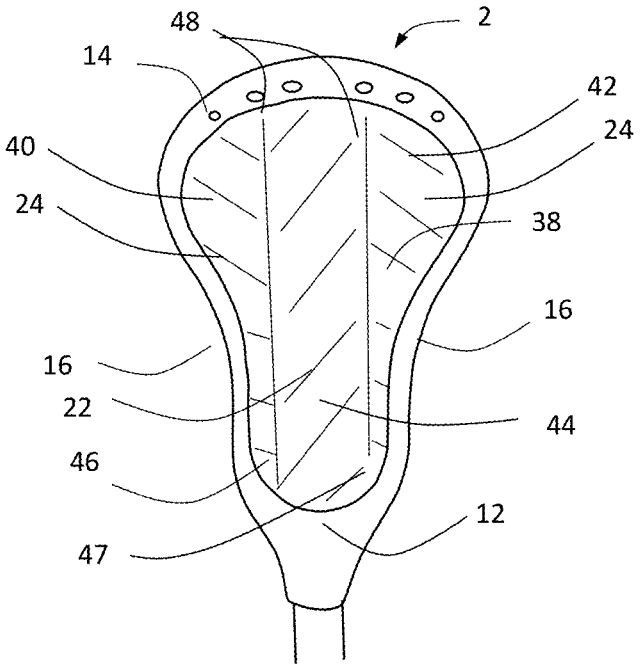
FIG. 9 is a plan view of a portion of a lacrosse stick having an example substrate according to the invention, showing first, second and central portions thereof.

FIG. 9 shows another embodiment, substrate 38, attached to head 2. The substrate 38 includes a first portion 40, a second portion 42 and a central portion 44. The first and second portions 40 and 42 are positioned proximate to the sidewalls 16. The central portion 44 extends from the ball stop 12 to the scoop 14 and is positioned between the first and second portions 40 and 42. The first and second portions, 40 and 42, may be knit with plain stitches 24. The central portion 44 may be knit with purl stitches 22. The substrate 38 may also include reinforcements 46 positioned in spaced apart relation to one another to advantageously direct the ball to and from the ball stop when the ball is caught or thrown. The reinforcements 46 are positioned between the first portion 40 and the central portion 44, and between the second portion 42 and the central portion 44. Each reinforcement 46 comprises a column 48 knit with plain stitches 24.

Figure 10:
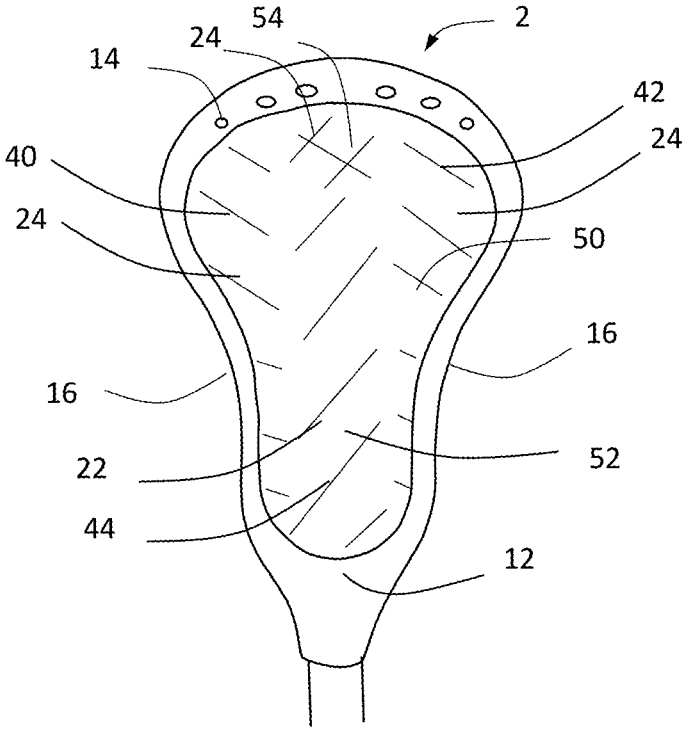
FIG. 10 is a plan view of a portion of a lacrosse stick having an example a substrate according to the invention, showing first, second and central portions thereof.

FIG. 10 shows a substrate 50 with the central portion 44, of substrate 38, including a first part 52 and a second part 54. The first part 52 extends from the ball stop 12 and the second part 54 is positioned between the first part 52 and the scoop 14. The first part 52 may be knit with purl stitches 22. The second part 54 may be knit with plain stitches 24.

The example substrates 4, 32, 34, 38, and 50 may be knit with yarn selected from a group consisting essentially of: nylon, waxed cotton, natural rope, micro-para cord and combinations thereof. Yarn from this group may be used to make the various example substrates according to the methods described below.

Figure 11:
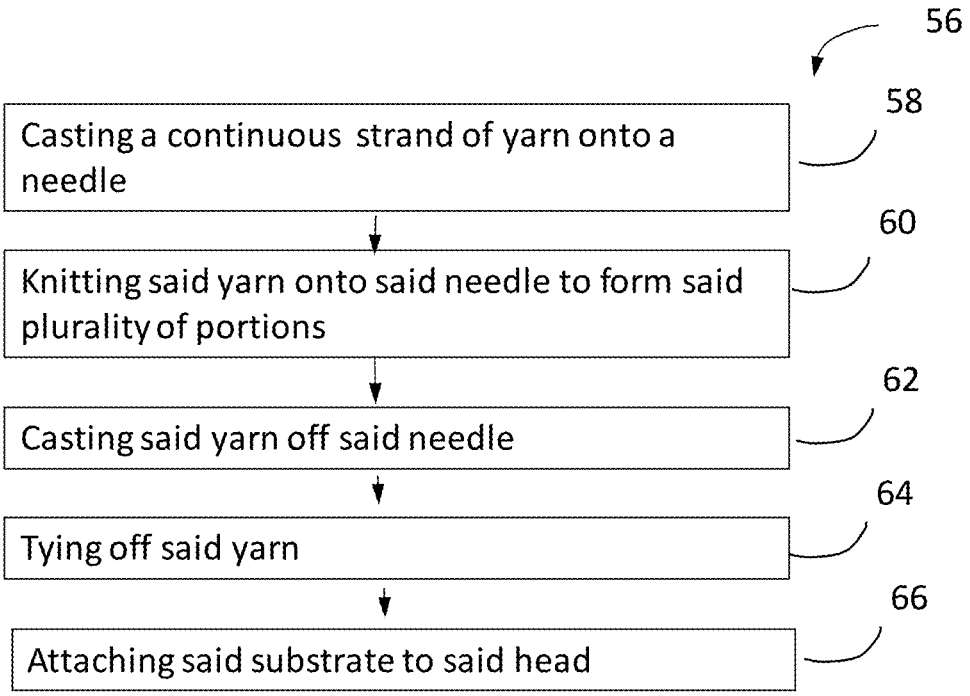
FIG. 11 is a flow chart of an example method of making a substrate according to the invention for a lacrosse stick with a plurality of portions thereof.

An example method 56 for making a substrate 4 (FIGS. 1 and 2) is shown in FIG. 11. The method 56 begins with the step 58 of casting a continuous strand of yarn onto a needle, such as a knitting needle. With the casting step 58, yarn is looped around the needle forming a first row until the desired width of the substrate 4 is reached. The number of loops of yarn along the needle is a function of a size of the needle and a circumference of the yarn. Once the casting step 58 is complete, subsequent steps continue with looping the yarn around the needle and through the previous row back and forth along the needle to complete subsequent rows. The method continues with the step 60 of knitting the yarn onto the needle to form the plurality of portions. The method further continues with the step 62 of casting the yarn off the needle, and onto the step 64 of tying off the yarn to prevent the portions from unraveling. After completion of step 66 the substrate 4 is formed and ready for the step 66 of attaching the substrate 4 to head 6 (see FIGS. 1 and 2). The substrate 4 may be attached to the head 6 by weaving nylon string through the outer periphery of the substrate and through the holes provided in the scoop 14, sides 16 and ball stop 12.

Figure 12:
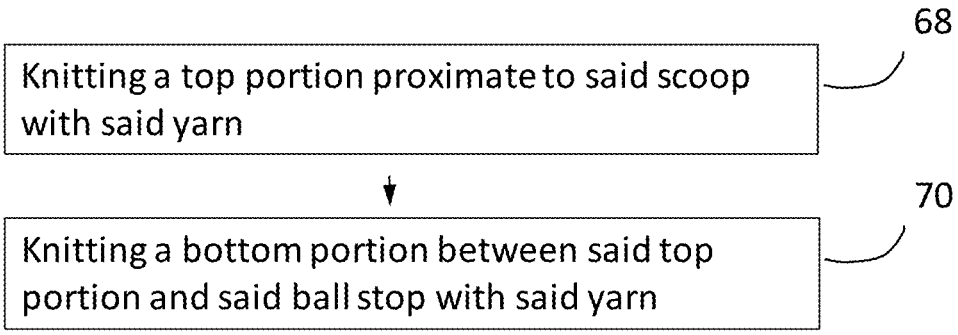
FIG. 12 is a flow chart depicting a portion of an example method of making a substrate according to the invention for a lacrosse stick with top and bottom portions.

FIG. 12 illustrates a flow chart depicting a portion of method 56 where the knitting the plurality of portions step 60, comprises step 68 of knitting a top portion 26 proximate to the scoop with yarn and step 70 of knitting a bottom portion 28 between the top portion and the ball stop with yarn.

Figure 13:
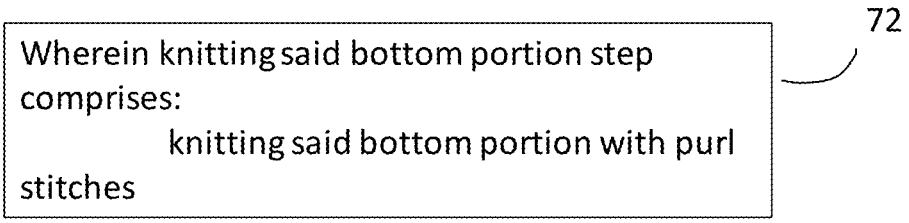
FIG. 13 is a flow chart depicting a portion of an example method of making a substrate according to the invention with top and bottom portions.
Figure 14:
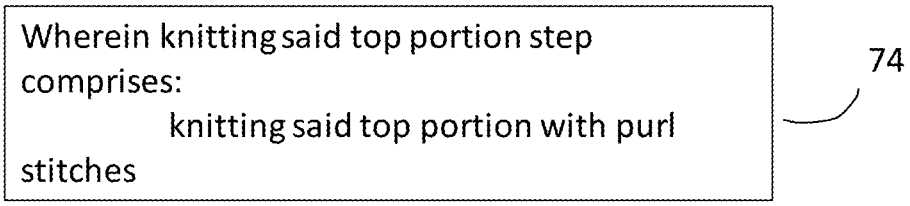
FIG. 14 is a flow chart depicting a portion of an example method of making a substrate according to the invention with top and bottom portions.

FIG. 13 illustrates a flow chart depicting a portion of method 56 where the knitting the bottom portion step 70, comprises the step 72 of knitting the bottom portion of substrate 4 with purl stitches. FIG. 14 shows a flow chart depicting a portion of method 56 where the knitting the top portion step 68 comprises the step 74 of knitting the top portion with purl stitches.

Figure 15:
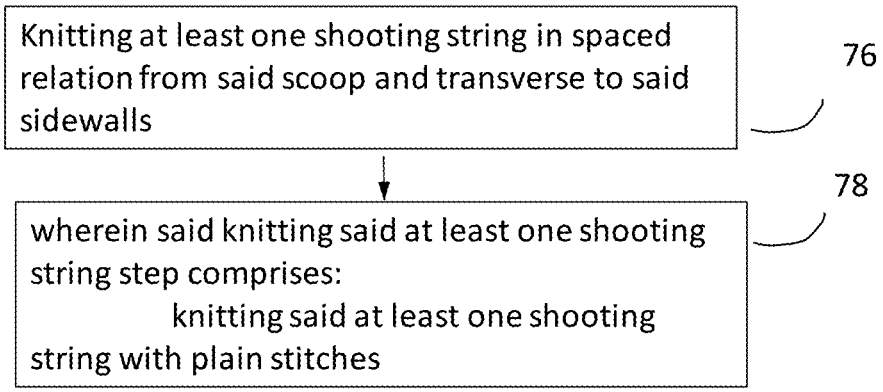
FIG. 15 is a flow chart depicting portions of an example method of making a substrate with shooting strings.
Figure 16:
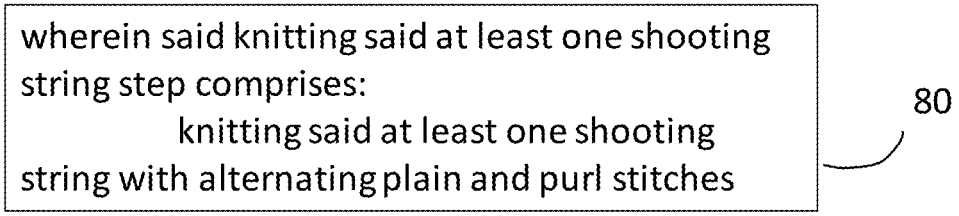
FIG. 16 is a flow chart depicting a portion of an example method of making a substrate with shooting strings.

FIG. 15 shows an example embodiment of a portion of method 56 of making substrate 4 further comprising the step 76 of knitting at least one shooting string in spaced relation from the scoop and transverse to the sidewalls. Step 76 may be implemented while knitting the top portion. The knitting at least one shooting string step comprises step 78 of knitting the at least one shooting string with plain stitches. FIG. 16 shows a flow chart depicting a portion of the method 56 where the knitting the at least one shooting string step 76 comprises the step 80 of knitting the at least one shooting string with alternating plain and purl stitches.

Figure 17:
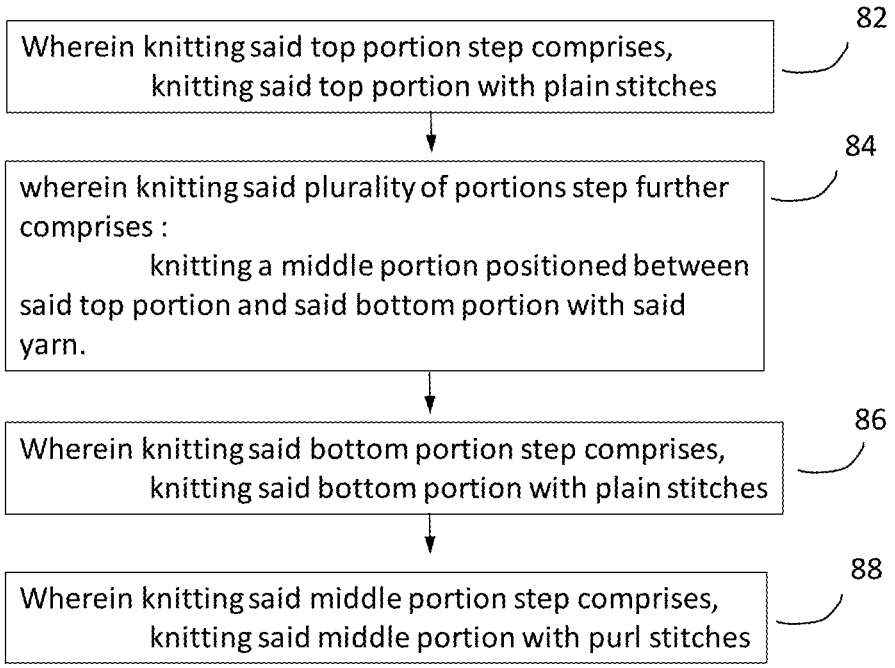
FIG. 17 is a flow chart depicting portions of an example method of making a substrate according to the invention with top, bottom, and middle portions.

FIG. 17 shows an example embodiment of a portion of method 56 of making substrate 34 (see FIG. 8), where the knitting the top portion step 68 (see FIG. 11) comprises the step 82 of knitting the top portion 26 with plain stitches. The knitting the plurality of portions step 60 (see FIG. 11), of method 56, may further comprise step 84 of knitting a middle portion 36 (see FIG. 8), positioned between the top portion and the bottom portion with the yarn. The kitting the bottom portion step 70 (see FIG. 12) may comprise step 86 of knitting the bottom portion with plain stitches. The knitting the middle portion step 84 may comprise step 88 of knitting the middle portion 36 with purl stitches.

An example of a portion of method 56 of making substrate 32 (see FIG. 7) may comprise step 72 (FIG. 13) of knitting the bottom portion with purl stitches, and step 82 (FIG. 17) of knitting the top portion with plain stitches.

Figure 18:
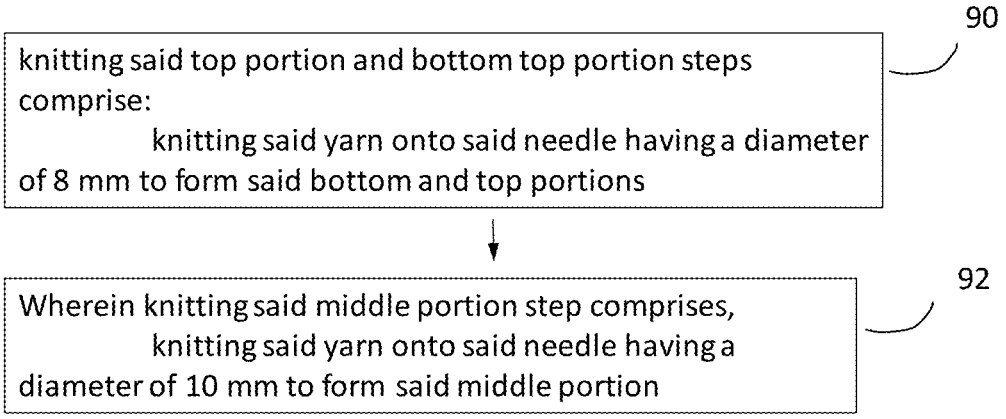
FIG. 18 is a flow chart depicting portions of an example method of making a substrate according to the invention with top, bottom and middle portions.

Another example of a portion of method 56 of making of substrate 32 is shown in FIG. 18. In this example, the knitting the top portion and bottom portion steps, 68 and 70 (FIG. 12) may comprise the step 90 of knitting the yarn onto the needle having a diameter of 8 mm to form the top and bottom portions. The knitting the middle portion step 84 (FIG. 17) may comprise the step 92 of knitting the yarn onto the needle having a diameter of 10 mm to form the middle portion. Substrate portions knit with different sized needles advantageously direct the ball to the substrate portion with yarn knit from the larger sized needle. Although this example pertains to the 8 mm and the 10 mm needle sizes, other combinations of needles with sizes ranging from 5 mm to 20 mm may be used.

Figure 19:
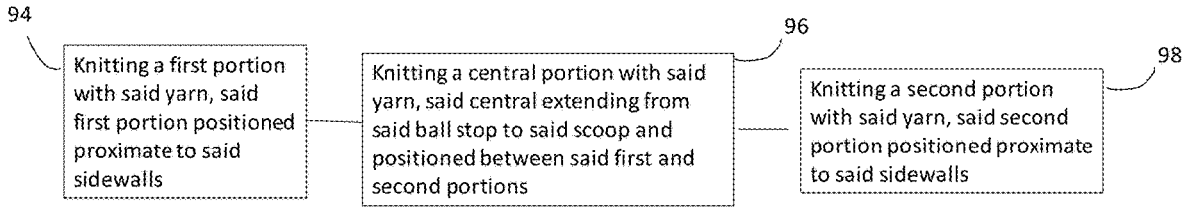
FIG. 19 is a flow chart depicting portions of an example method of making a substrate according to the invention with first, second and central portions.

FIG. 19 shows an example of a portion of method 56 of making a substrate 38 (see FIG. 9) where the knitting the plurality of portions step 60, comprises step 94 of knitting the first portion, step 96 of knitting the central portion, and step 98 of knitting the second portion. Once the casting step 58 is complete, the subsequent steps, step 94 of knitting the first portion, step 96 of knitting the central portion, and step 98 of knitting the second portion, continue with looping the yarn to form the first, central and second portions back and forth along the needle to complete subsequent rows to form substrate 38.

Figure 20:
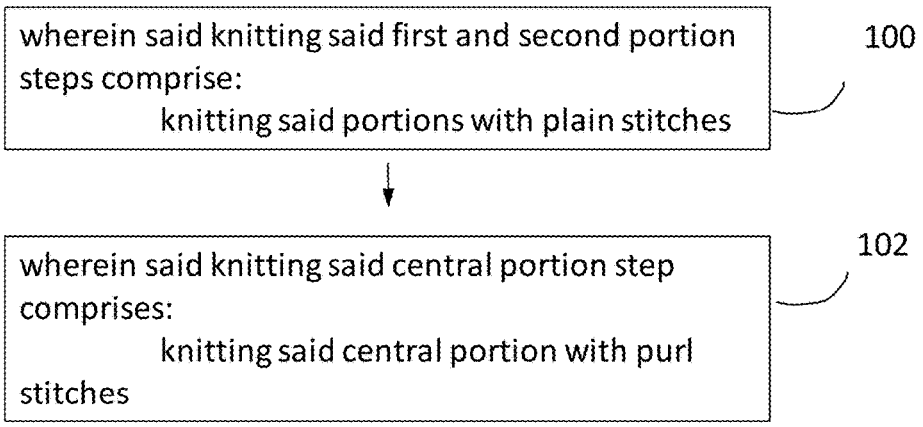
FIG. 20 is a flow chart depicting a portion of an example method of making a substrate according to the invention with first, second and central portions.

FIG. 20 shows an example embodiment of a portion of method 56 of making substrate 38. In this example, the knitting the first and second portions steps 94 and 98 may comprise the step 100 of knitting the first and second portions with plain stitches. The knitting of the central portion step 96 may comprise the step 102 of knitting the central portion with purl stitches.

Figure 21:
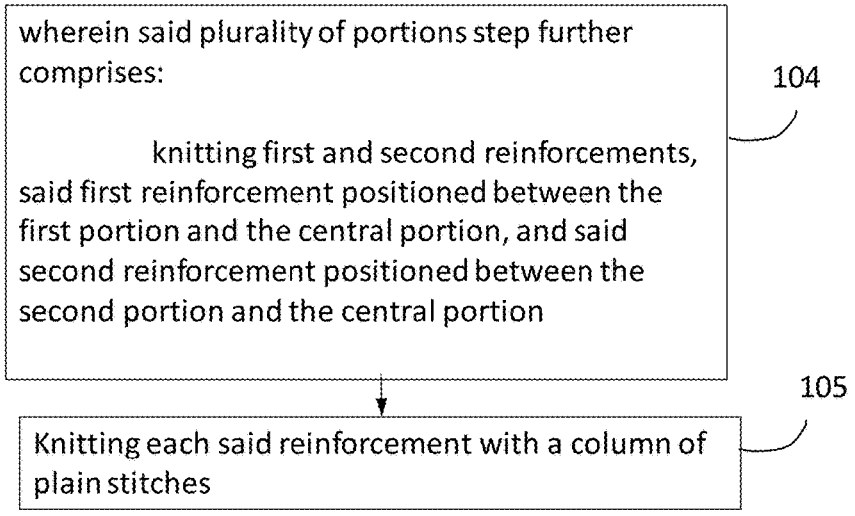
FIG. 21 is a flow chart depicting a portion of an example method of making a substrate according to the invention with first, second, and central portions.

FIG. 21 shows an example embodiment of a portion of method 56 of making substrate 38 with the reinforcements 46, further comprising the step 104 of knitting each reinforcement 46 with a column of plain stitches.

Figure 22:
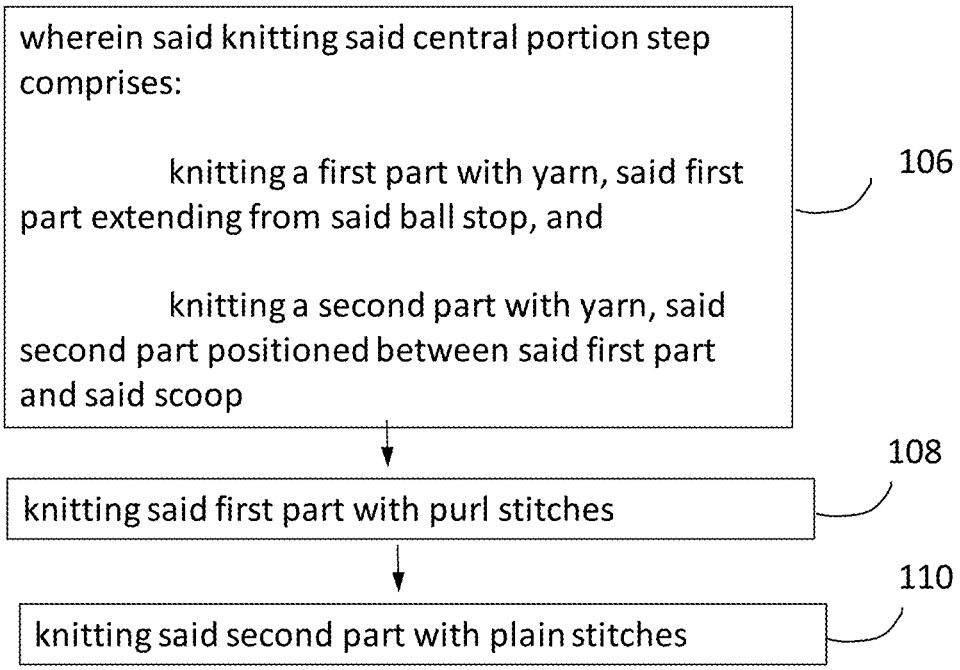
FIG. 22 is a flow chart depicting a portion of an example method of making a substrate according to the invention with first and second portions, and a central portion with first and second parts.

FIG. 22 shows an example of a portion of method 56 of making a substrate 50. In this example, the knitting the central portion step 102 (see FIG. 20) may comprise step 106 of knitting a first part and a second part with yarn. The first part extends from the ball stop and the second part is positioned between the first part and the scoop (see FIG. 10). The knitting the central portion step 96 (FIG. 19) may comprise step 108 of knitting the first part with purl stitches, and step 110 of knitting the second part with plain stitches.

Figure 23:
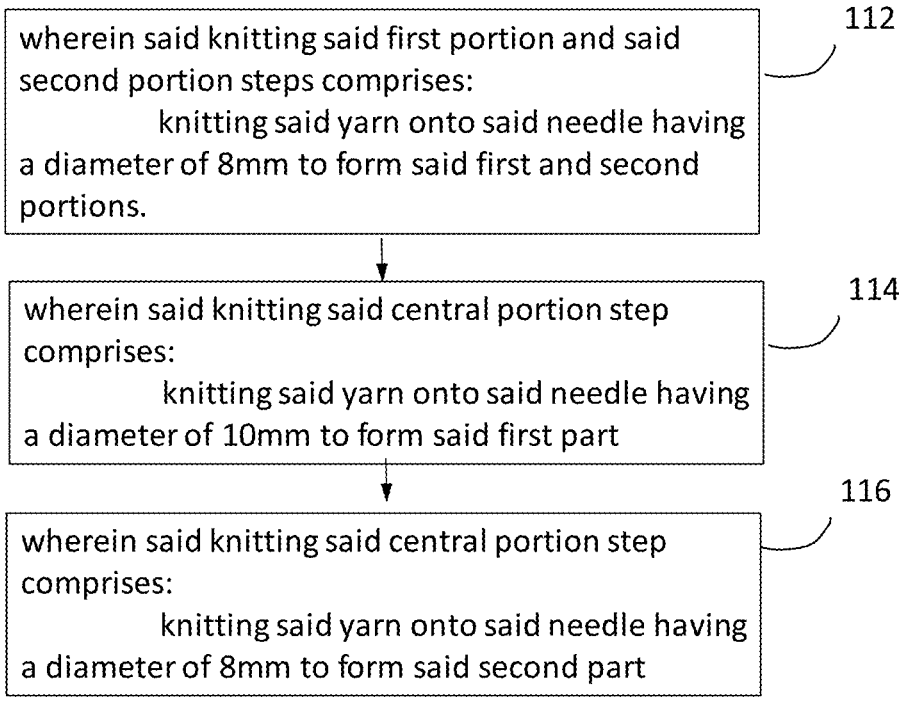
FIG. 23 is a flow chart depicting a portion of an example method of making a substrate according to the invention with first and second portions, and a central portion with first and second parts.

FIG. 23 shows an example of a portion of method 56 of making a variation of substrate 50. Steps 94 and 98 of knitting the first and second portions (FIG. 19) may comprise the step 112 of knitting the yarn onto the needle which has a diameter of 8 mm to form the first and second portions. Step 98 of knitting the central portion step 96 (see FIG. 19) may comprise the step 114 of knitting the yarn onto the needle which has a diameter of 10 mm to form the first part. Step 96 (see FIG. 19) may further comprise a step 116 of knitting the yarn onto the needle which has a diameter of 8 mm to form the second part.

Figure 24:
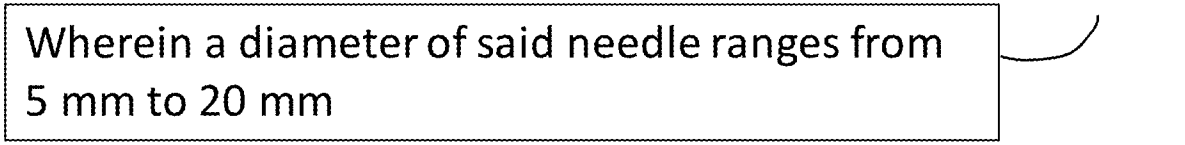
FIG. 24 is a flow chart depicting a portion of an example method of making a substrate according to the invention.

FIG. 24 shows step 118 where the diameter of the needle in step 60 of method 56, ranges from 1.5 mm to 10 mm.

The substrates including a plurality of knitted portions mountable on a lacrosse stick head 2 according to the invention are expected to provide advantages including: improved ball retention; improved ball guidance from the ball stop toward the scoop when throwing the ball; and improve ball guidance from the scoop toward the ball stop when catching the ball.

What is claimed is:

1. A substrate mountable on a lacrosse stick head, said head including a throat attached to a shaft, a ball stop attached to said throat, a scoop distal to said throat, and sidewalls extending between said ball stop and said scoop, said substrate comprising:

a plurality of portions having different stiffness characteristics, said portions comprise a continuous strand of yarn knit to form said substrate;

wherein said plurality of portions comprise:

a first portion and a second portion, said portions positioned proximate to said sidewalls; and a central portion extending from said ball stop to said scoop and positioned between said first and second portions;

wherein said first and second portions are knit with plain stitches; and wherein said central portion is knit with purl stitches; wherein each stitch of the plain stitches and the purl stitches is un-fixed to permit relative movement of the stitch along the substrate.

2. The substrate according to claim 1, wherein said plurality of portions comprise:

a top portion positioned proximate to said scoop; and a bottom portion positioned between said top portion and said ball stop, wherein said top portion comprises at least one shooting string positioned in spaced relation from said scoop, and transverse to said sidewalls.

3. The substrate according to claim 2, wherein said at least one shooting string comprises a row of plain stitches.

4. The substrate according to claim 2, wherein said at least one shooting string comprises a row knit with alternating plain and purl stitches.

5. The substrate according to claim 2, wherein said at least one shooting string comprises a fiber, attached to said substrate, said fiber selected from a group consisting essentially of: cotton cord, nylon cord, polyester-cotton cord, cotton shoelace, nylon shoelace, polyester-cotton shoelace, hockey shoelace and combinations thereof.

6. The substrate according to claim 1, wherein said top portion is knit with plain stitches.

7. The substrate according to claim 6, further comprising a middle portion positioned between said top portion and said bottom portion, said middle portion comprising yarn knit to form said substrate.

8. The substrate according to claim 7, wherein said bottom portion is knit with plain stitches.

9. The substrate according to claim 7, wherein said middle portion is knit with purl stiches.

10. The substrate according to claim 1, wherein said yarn is selected from a group consisting essentially of: nylon, waxed cotton, natural rope, micro-para cord and combinations thereof.

11. The substrate according to claim 1, further comprising reinforcements in spaced apart relation to one another, said reinforcements positioned between said first portion and said central portion and between said second portion and said central portion, each said reinforcement comprises a column knit with plain stitches.

12. The substrate according to claim 1, wherein said central portion comprises a first part extending from said ball stop and a second part positioned between said first part and said scoop.

13. The substrate according to claim 12, wherein said first part is knit with purl stitches.

14. The substrate according to claim 12, wherein said second part is knit with plain stitches.

15. The substrate according to claim 1, wherein the first portion, second portion, and central portion are integrally formed, wherein the first portion and the central portion are adjoined by stitches of the continuous strand of yarn, and wherein the second portion and the central portion are adjoined by stitches of the continuous strand of yarn.

16. The substrate according to claim 1, wherein the substrate consists of the continuous strand that forms the plurality of portions of the substrate.

17. A lacrosse stick, said stick comprising:

a shaft;

a head comprising a throat attached to said shaft, a ball stop attached to said throat, a scoop distal to said throat, and sidewalls extending between said ball stop and said scoop;

a substrate comprising a plurality of portions having different stiffness characteristics, said portions comprise a continuous strand of yarn knit to form said substrate;

wherein said plurality of portions comprise:

a first portion and a second portion, said portions positioned proximate to said sidewalls; and a central portion extending from said ball stop to said scoop and positioned between said first and second portions;

wherein said first and second portions are knit with plain stitches; and wherein said central portion is knit with purl stitches; wherein each stitch of the plain stitches and the purl stitches is un-fixed to permit relative movement of the stitch along the substrate.

18. A method of making a substrate mountable on a lacrosse stick head, said head including a throat attached to a stick, a ball stop attached to said throat, a scoop distal to said throat, and sidewalls extending between said ball stop and said scoop, said substrate comprising a plurality of portions having different stiffness characteristics, said method comprising:

casting a continuous strand of yarn onto a needle;

knitting said portions with said yarn comprising:

knitting a first portion and a second portion onto said needle having a first diameter to form said first and second portions, said portions positioned proximate to said sidewalls; and knitting a central portion extending from said ball stop to said scoop and positioned between said first and second portions onto said needle having a second diameter to form said central portion;

casting said yarn off said needle;

tying off said yarn; and attaching said substrate to said head;

wherein said second diameter is greater than said first diameter; wherein said first and second portions are knit with plain stitches; and wherein said central portion is knit with purl stitches; wherein each stitch of the plain stitches and the purl stitches is un-fixed to permit relative movement of the stitch along the substrate.

19. The method according to claim 18, wherein said knitting said plurality of portions step further comprises:

knitting a top portion proximate to said scoop with said yarn; and knitting a bottom portion between said top portion and said ball stop with said yarn.

20. The method according to claim 19, wherein said knitting said bottom portion step further comprises, knitting said bottom portion with purl stitches.

21. The method according to claim 19, where said knitting said top portion step further comprises, knitting said top portion with purl stitches.

22. The method according to claim 19, wherein said knitting said plurality of portions step further comprises:

knitting a middle portion positioned between said top portion and said bottom portion with said yarn.

23. The method according to claim 22, wherein said knitting said top and bottom portion steps comprise, knitting said top and bottom portions with plain stitches.

24. The method according to claim 22, wherein said knitting said middle portion step comprises, knitting said middle portion with purl stitches.

25. The method according to claim 22, wherein said first diameter comprises a diameter of 8 mm.

26. The method according to claim 22, wherein said second diameter comprises a diameter of 10 mm.

27. The method according to claim 18, wherein said casting step comprises, casting said yarn onto said needle comprising a diameter ranging from 5 mm to 20 mm.

* * * * *